US005098457A

United States Patent [19]

Cheung et al.

[11] Patent Number: 5,098,457

[45] Date of Patent: Mar. 24, 1992

[54] METHOD AND APPARATUS FOR PRODUCING ELEVATED PRESSURE NITROGEN

[75] Inventors: Harry Cheung, Williamsville; Dante P. Bonaquist, Grand Island, both of N.Y.

[73] Assignee: Union Carbide Industrial Gases Technology Corporation, Danbury, Conn.

[21] Appl. No.: 644,228

[22] Filed: Jan. 22, 1991

[51] Int. Cl.[5] ..... F25J 3/02

[52] U.S. Cl. ..... 62/24; 62/33; 62/41

[58] Field of Search ..... 62/23, 24, 33, 41

[56] References Cited

U.S. PATENT DOCUMENTS

| | | | |
|---|---|---|---|
| 4,006,001 | 2/1977 | Schonpflug | 62/41 |
| 4,222,756 | 9/1980 | Thorogood | 62/13 |
| 4,439,220 | 3/1984 | Olszewski et al. | 62/31 |
| 4,448,595 | 5/1984 | Cheung | 62/31 |
| 4,453,957 | 6/1984 | Pahade et al. | 62/25 |
| 4,595,405 | 6/1986 | Perawal et al. | 62/33 |
| 4,717,410 | 1/1988 | Grenier | 62/29 |
| 4,822,395 | 4/1989 | Cheung | 62/22 |

*Primary Examiner*—Ronald C. Capossela
*Attorney, Agent, or Firm*—Stanley Ktorides

[57] ABSTRACT

A method and apparatus for producing elevated pressure nitrogen with improved recovery comprising a primary column and a lower pressure auxiliary column wherein auxiliary column top vapor is condensed, pressurized and passed into the primary column.

16 Claims, 3 Drawing Sheets

METHOD AND APPARATUS FOR PRODUCING ELEVATED PRESSURE NITROGEN

TECHNICAL FIELD

This invention relates generally to the cryogenic separation of air to produce nitrogen and more particularly to the production of elevated pressure nitrogen.

BACKGROUND ART

High purity nitrogen at superatmospheric pressure is used in a number of applications such as blanketing, stirring, transporting and inerting in many industries such as glassmaking, aluminum production and electronics. In addition large quantities of nitrogen are used in enhanced oil or gas recovery operations after booster compression to high pressures.

One important method for producing nitrogen at elevated pressure is by the cryogenic rectification or separation of air using a single column. A disadvantage with such a system is that it can efficiently produce elevated pressure nitrogen only at relatively low recovery rates. Generally single column systems can efficiently recover only about 42 percent of the feed air as product elevated pressure nitrogen.

The recovery of nitrogen by the cryogenic separation of air can be increased by employing a double column cryogenic rectification system wherein a higher pressure column and a lower pressure column are in heat exchange relation. While such a system improves nitrogen recovery, a significant amount of the nitrogen recovered is at a lower pressure. Thus, if elevated pressure nitrogen is required, the lower pressure nitrogen must be compressed to the higher pressure thus adding both capital costs and operating costs to the nitrogen production system.

It is thus desirable to have a system which can produce elevated pressure nitrogen with improved recovery.

Accordingly it is an object of this invention to provide a method for producing elevated pressure nitrogen by the cryogenic rectification of air with improved recovery.

It is another object of this invention to provide an apparatus for producing elevated pressure nitrogen by the cryogenic rectification of air with improved recovery.

SUMMARY OF THE INVENTION

The above and other objects which will become apparent to one skilled in the art upon a reading of this disclosure are attained by the present invention one aspect of which is:

A method for producing elevated pressure nitrogen with improved recovery comprising:

(A) providing compressed feed air into a primary column operating at a pressure within the range of from 80 to 150 pounds per square inch absolute;

(B) separating the feed air in the primary column into nitrogen-richer component and oxygen-enriched component;

(C) providing oxygen-enriched component into an auxiliary column operating at a pressure less than that of the primary column;

(D) separating oxygen-enriched component into nitrogen-enriched vapor and oxygen-richer liquid;

(E) condensing nitrogen-enriched vapor by indirect heat exchange with oxygen-richer liquid to produce nitrogen-enriched liquid;

(F) increasing the pressure of the nitrogen-enriched liquid to substantially the operating pressure of the primary column;

(G) providing pressurized nitrogen-enriched liquid into the primary column for further production of nitrogen-richer component; and (H) recovering nitrogen-richer component from the primary column as product elevated pressure nitrogen.

Another aspect of this invention comprises:

Apparatus for producing elevated pressure nitrogen with improved recovery comprising:

(A) a primary column having a top condenser and means for providing feed into the primary column;

(B) means for providing fluid from the lower portion of the primary column into the top condenser;

(C) an auxiliary column having a top condenser;

(D) means for providing fluid from the primary column top condenser into the auxiliary column;

(E) means for providing liquid from the auxiliary column top condenser into the primary column including means for increasing the pressure of said liquid; and (F) means for recovering product from the primary column.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column, or on packing elements, or a combination thereof. For an expanded discussion of fractionation columns see the Chemical Engineer's Handbook, Fifth Edition, edited by R. H. Perry and C. H. Chilton, McGraw-Hill Book Company, New York Section 13, "Distillation' B. D. Smith et al, page 13—3, *The Continuous Distillation Process.*

The term "top condenser" is used herein to mean the respective primary column or auxiliary column condenser wherein vapor from the column is condensed to provide reflux by indirect heat exchange with vaporizing liquid at a lower pressure.

The term "indirect heat exchange" is used herein to mean the bringing of two fluid streams into heat exchange relation without any physical contact or intermixing of the fluids with each other.

The term "turboexpansion" is used herein to mean the conversion of the pressure energy of a gas into mechanical work by expansion of the gas through a device such as a turbine.

DETAILED DESCRIPTION

The method and apparatus of this invention will be described in detail with reference to the Drawings.

Figure 1:
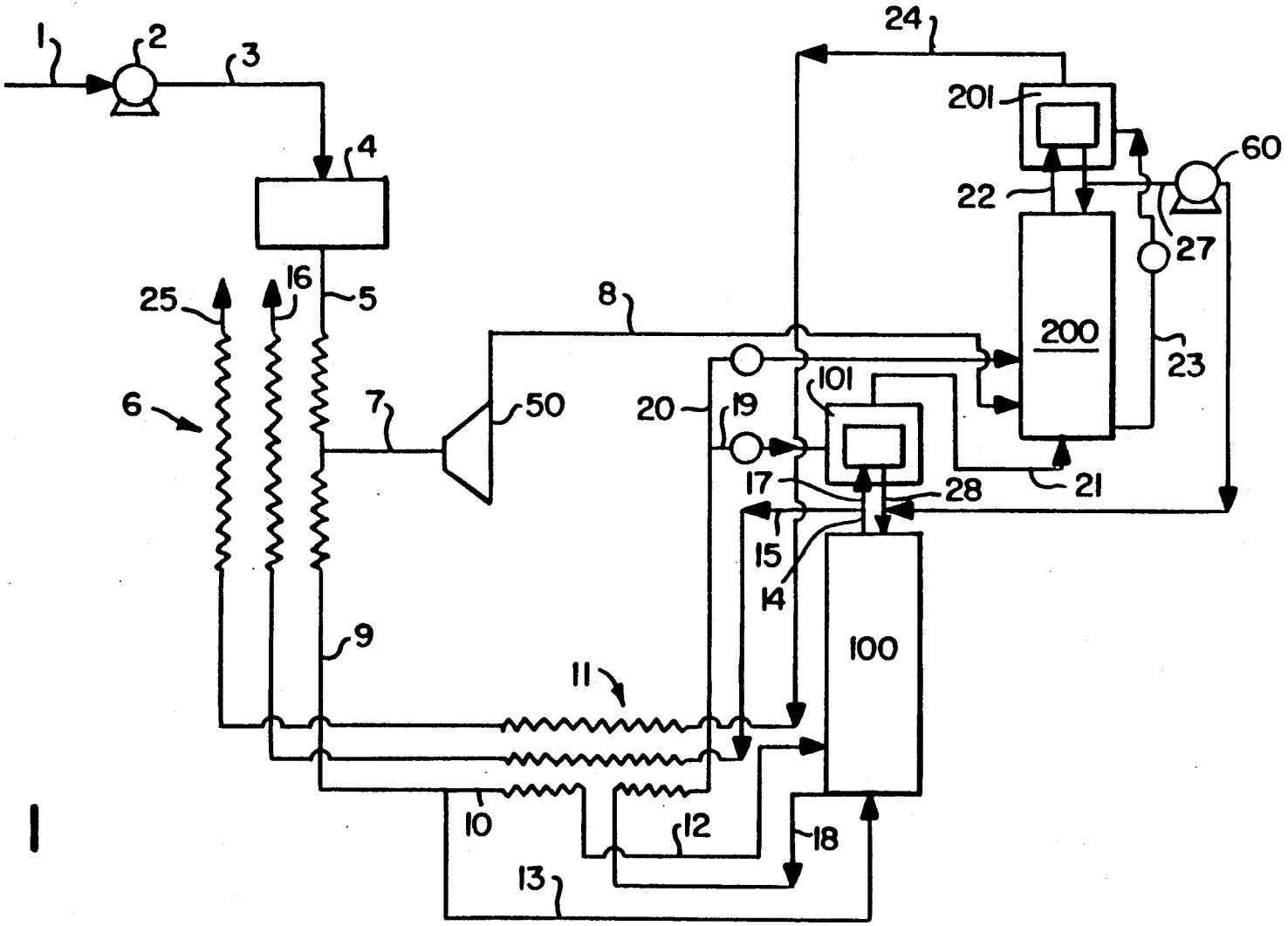
FIG. 1 is a schematic representation of one embodiment of the invention.

Referring now to FIG. 1, feed air 1 is compressed by passage through compressor 2 and the resulting compressed feed air 3 is cleaned of high boiling impurities such as water vapor and carbon dioxide by passage through prepurifier 4. Typically prepurifier 4 comprises molecular sieve beds. Compressed, cleaned feed air 5 is then cooled by passage through heat exchanger 6 by indirect heat exchange with return streams. A portion 7 of the feed air is turboexpanded by passage through turboexpander 50 thus generating refrigeration, and this refrigeration is put into the nitrogen production system as resulting turboexpanded air stream 8 is provided into auxiliary column 200. Generally, if employed, feed air portion 7 will be from about 5 to 20 percent of the incoming feed air 1.

Cooled, cleaned, compressed feed air 9 is then passed into primary column 100 which is operating at a pressure within the range of from 80 to 150 pounds per square inch absolute (psia), preferably within the range of from 100 to 130 psia. FIG. 1 illustrates a preferred embodiment of the invention wherein a portion 10 of the feed air is liquified by passage through heat exchanger 11 by indirect heat exchange with return streams. Resulting liquified feed air portion 12 and gaseous feed air portion 13 are provided into primary column 100. If employed, liquified feed air portion 12 will comprise up to about 10 percent of incoming feed air 1.

Within primary column 100 the feed air is separated by cryogenic rectification into nitrogen-richer component and oxygen-enriched component. The nitrogen-richer component will generally have a nitrogen concentration of at least about 99 percent and may have a nitrogen concentration of up to 99.9999 percent or more. The oxygen-enriched component will generally have an oxygen concentration within the range of from 30 to 45 percent.

Gaseous nitrogen-richer component 14 may be passed out of primary column 100. A portion 15 of the nitrogen-richer component is warmed by passage through heat exchangers 11 and 6 and recovered as product elevated pressure nitrogen gas 16. The pressure of the product gas may be up to the operating pressure of the primary column less pressure drop in the recovery conduit. Another portion 17 of the nitrogen-richer component is provided into primary column top condenser 101. Also provided into top condenser 101 is oxygen-enriched component taken as liquid stream 18 from or near the bottom of primary column 100. In the embodiment illustrated in FIG. 1 stream 18 is cooled by passage through heat exchanger 11. A portion 19 of cooled stream 18 is passed into top condenser 101 while another portion 20 is provided directly into auxiliary column 200.

Within primary column top condenser 101 nitrogen-richer component 17 is condensed by indirect heat exchange with oxygen-enriched component supplied to top condenser 101 such that the oxygen-enriched component is at least partially vaporized. In the embodiment illustrated in FIG. 1 the oxygen-enriched component is completely vaporized by the heat exchange within top condenser 101 and the resulting vapor is provided as stream 21 into auxiliary column 200 at or near the bottom of the column. Resulting condensed nitrogen-richer component 28 is employed as liquid reflux for primary column 100. If desired, a portion of the nitrogen-richer component from top condenser 101 may be recovered as product liquid nitrogen.

Auxiliary column 200 operates at a pressure less than that of primary column 100. Generally the operating pressure of auxiliary column 200 will be within the range of from 40 to 70 psia, preferably within the range of from 45 to 60 psia. Within auxiliary column 200 the feed or feeds into the column are separated by cryogenic rectification into nitrogen-enriched vapor and oxygen-richer liquid. The feed into auxiliary column 200 will include one or more streams of oxygen-enriched component and may also include a turboexpanded feed air stream. Generally the nitrogen-enriched vapor will have a nitrogen concentration within the range of from 90 to 100 percent and the oxygen-richer liquid will have an oxygen concentration within the range of from 45 to 65 percent.

Nitrogen-enriched vapor 22 and oxygen-richer liquid 23 are provided into auxiliary column top condenser 201 wherein nitrogen-enriched vapor is condensed by indirect heat exchange with vaporizing oxygen-richer liquid. The resulting oxygen-richer vapor is passed from top condenser 201 as stream 24 through heat exchangers 11 and 6 and out of the system as stream 25. The resulting nitrogen-enriched liquid is passed 26 into auxiliary column 200 as liquid reflux.

A portion 27 of the nitrogen-enriched liquid is increased in pressure to substantially that of primary column 100 and then provided into primary column 100. A preferred means of increasing the pressure of the nitrogen-enriched liquid is by passing the liquid through a liquid pump such as liquid pump 60 illustrated in FIG. 1. The pressurized nitrogen-enriched liquid may be conveniently provided into primary column 100 by combination with the liquid reflux stream 28. The pressurized nitrogen-enriched liquid provided into primary column 100 enables the production of further nitrogen-richer component and consequent elevated pressure nitrogen product.

While preferred, the pressurized recycled nitrogen liquid stream need not be combined with reflux stream 28, but rather may be inserted into the top section of primary column 100, for example, if its purity is slightly less than that of stream 28. The recycled nitrogen liquid stream back to the primary column provides additional nitrogen liquid reflux so that a large gaseous nitrogen stream can be withdrawn from the top of the primary column to produce a gaseous nitrogen product stream at a single elevated pressure from the column system.

Figure 2:
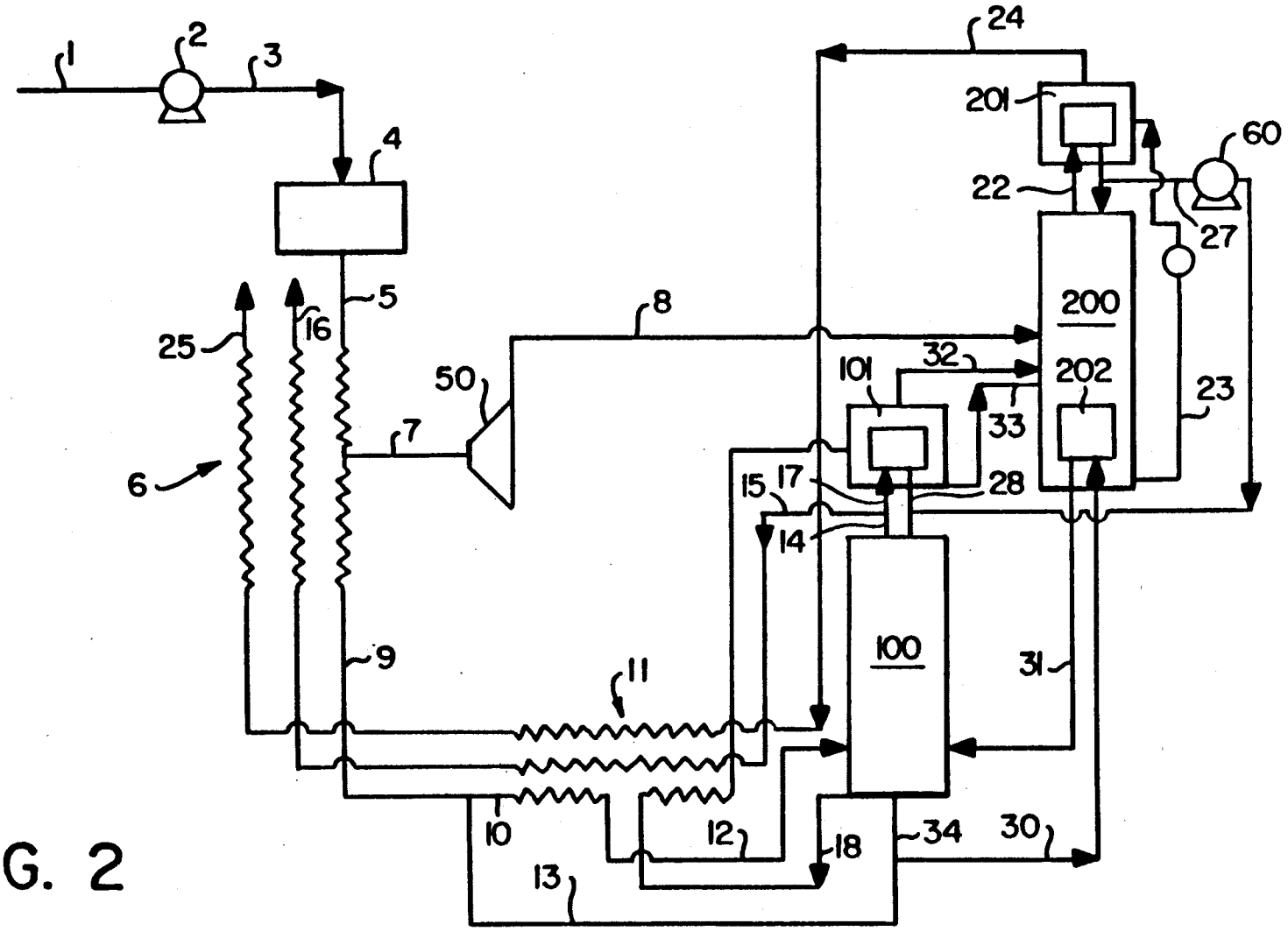
FIG. 2 is a schematic representation of a preferred embodiment of the invention wherein feed air turboexpansion is employed to generate refrigeration.

FIG. 2 illustrates a particularly preferred embodiment of the invention wherein a portion of the cooled, cleaned, compressed feed air is liquified by indirect heat exchange with auxiliary column bottoms prior to introduction into the primary. The numerals in FIG. 2 correspond to those of FIG. 1 for the common elements and the descriptions of these common elements will not be repeated.

Referring now to FIG. 2 a portion 30 of the cooled, cleaned, compressed feed air is provided into bottom reboiler 202 wherein it is condensed by indirect heat exchange with vaporizing bottom liquid of auxiliary column 200 thus providing vapor boilup for auxiliary column 200. Portion 30, if employed, may be from 1 to 30 percent of incoming feed air 1. The remaining portion 34 of stream 13 is provided directly into column 100. Resulting liquified air is passed as stream 31 into primary column 100. As a consequence of the air boiling of auxiliary column 200 bottoms, vapor from primary column top condenser 101 need not be passed into the bottom of auxiliary column 200. In the embodiment illustrated in FIG. 2 the entire portion of stream 18 is passed into top condenser 101 wherein the oxygen-enriched liquid component is partially vaporized against condensing nitrogen-richer component. The resulting oxygen-enriched vapor and remaining oxygen-enriched liquid are passed from top condenser 101 as streams 32 and 33 respectively into auxiliary column 200, both at points above reboiler 202 but below the introduction point of turboexpanded feed air stream 8. The addition of auxiliary column reboiler 202 increases the nitrogen recovery over that of the simpler arrangement illustrated in FIG. 1 by enriching the oxygen content of stream 23 which becomes the waste rejection stream 24. Passing the entire stream 18 into top condenser 101 is a feature which allows feed stream 1 to be at its lowest pressure for the column system.

Figure 3:
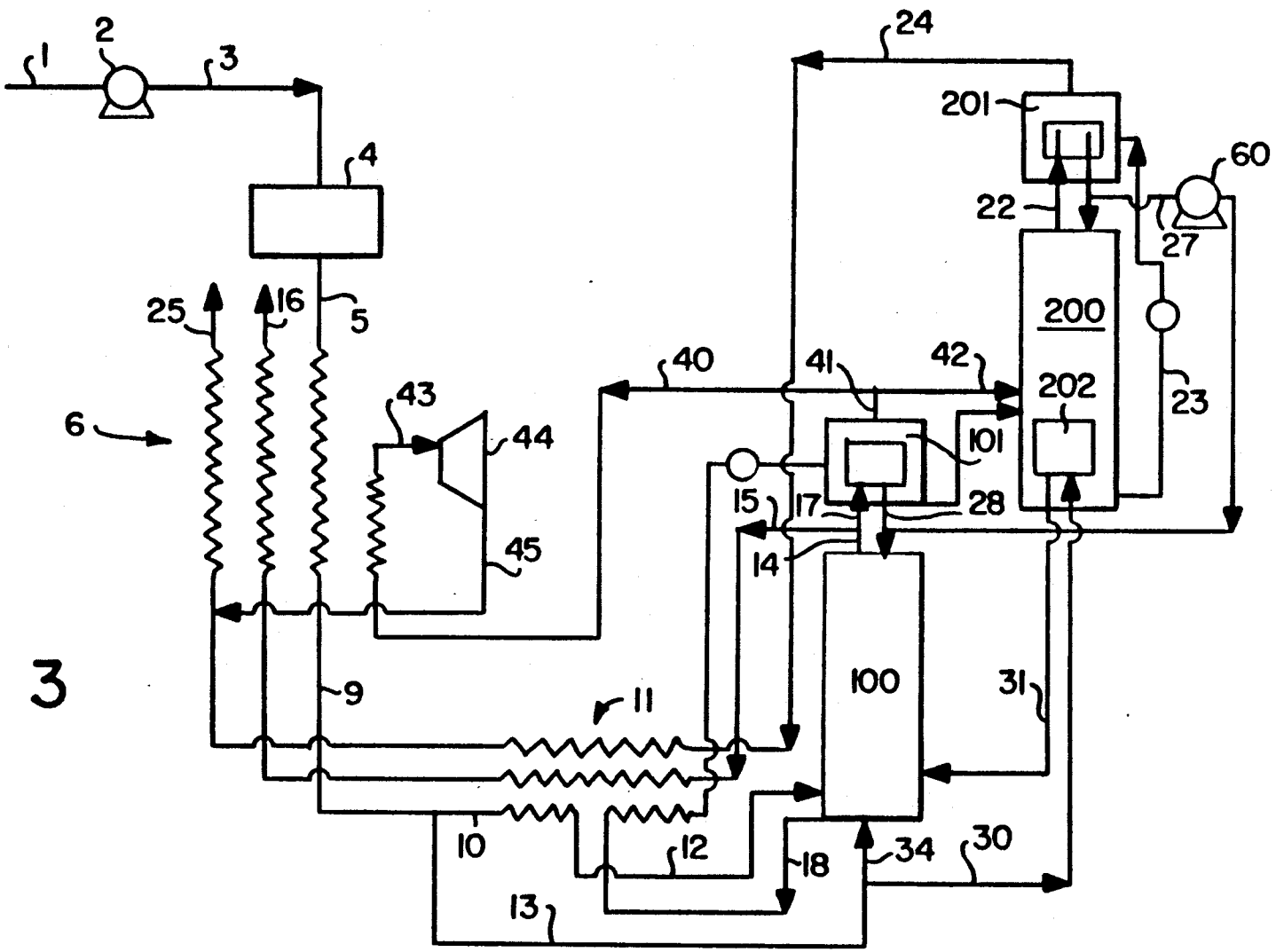
FIG. 3 is a schematic representation of another preferred embodiment of the invention wherein a waste stream is turboexpanded to generate refrigeration.

FIG. 3 illustrates another preferred embodiment of the invention wherein a waste stream rather than a feed air stream is turboexpanded to generate refrigeration. The numerals in FIG. 3 correspond to those of FIGS. 1 and/or 2 for the common elements and the description of these common elements will not be repeated.

Referring now to FIG. 3, the entire portion of feed air stream 5 fully traverses heat exchanger 6. A portion 40 of oxygen-enriched vapor 41 from top condenser 101 is warmed by partial traverse of heat exchanger 6 while another portion 42 of oxygen-enriched vapor 41 is passed into auxiliary column 200. Warmed oxygen-enriched vapor 43 is turboexpanded by passage though turboexpander 44 to generate refrigeration and the resulting turboexpanded stream 45 is passed through heat exchanger 6, such as by combination with stream 24, thus transferring added refrigeration to the incoming feed air and into the system. The resulting warmed stream is removed from the system such as with waste stream 25.

Computer simulations of the invention were carried out in accord with the embodiments illustrated in FIGS. 2 and 3 and the data generated by these simulations is presented in Tables 1 and 2 respectively. The stream numbers in the Tables correspond to those of the Figures.

TABLE 1

| Stream No. | Flow | Temp. (°K.) | Pressure (psia) | Oxygen Composition (mole fraction) |
|---|---|---|---|---|
| 5 | 100 | 280 | 106 | 0.2095 |
| 7 | 15 | 150 | 104 | 0.2095 |
| 9 | 85 | 104 | 104 | 0.2095 |
| 34 | 60 | 104 | 104 | 0.2095 |
| 30 | 15 | 104 | 104 | 0.2095 |
| 15 | 56.5 | 98.5 | 102 | <100 ppm |
| 10 | small | 104 | 104 | 0.2095 |
| 27 | 24 | 89.4 | 49.6 | <100 ppm |
| 24 | 43.5 | 88 | 17.5 | 0.4818 (0.0193 argon) |

TABLE 2

| Stream No. | Flow | Temp. (°K.) | Pressure (psia) | Oxygen Composition (mole fraction) |
|---|---|---|---|---|
| 5 | 100 | 280 | 106 | 0.2095 |
| 34 | 75 | 104 | 104 | 0.2095 |
| 30 | 25 | 104 | 104 | 0.2095 |
| 40 | 10 | 97 | 53 | — |
| 42 | small | 104 | 104 | 0.2095 |
| 15 | 54.9 | 98.5 | 102 | <100 ppm |
| 27 | 19.4 | 90 | 52 | <100 ppm |
| 34 | 35.1 | 88.5 | 17.5 | — |

As can be seen, the embodiment of the invention illustrated in FIG. 2 will enable the recovery of 56.5 percent of the incoming feed air as product elevated pressure nitrogen and the embodiment of the invention illustrated in FIG. 3 will enable the recovery of 54.9 percent of the incoming feed air as product elevated pressure nitrogen.

For comparative purposes a computer simulation was carried out of a typical single column nitrogen generator cycle. With this conventional cycle only 40.6 percent of the incoming feed air could be recovered as product elevated pressure nitrogen. Thus the invention enables the recovery of over 30 percent more of elevated pressure nitrogen over that attainable with a conventional single column nitrogen generator system.

Although the invention has been described in detail with reference to certain embodiments, those skilled in the art will recognize that there are other embodiments of the invention within the spirit and the scope of the claims. For example system refrigeration may be generated by the turboexpansion of a portion of the nitrogen-richer component from the primary column thus producing some nitrogen product at a lower pressure. This alternative may be advantageous if some lower pressure nitrogen product is desired. Also, if convenient, system refrigeration may be generated by turboexpansion of an oxygen enriched vapor stream taken from the auxiliary column. One or both of the top condensers could be within their respective columns as opposed to outside as illustrated in the Figures. Furthermore the auxiliary column reboiler illustrated in FIGS. 2 and 3 could be outside the auxiliary column.

We claim:

1. A method for producing elevated pressure nitrogen with improved recovery comprising:

(A) providing compressed feed air into a primary column operating at a pressure within the range of from 80 to 150 pounds per square inch absolute;

(B) separating the feed air in the primary column into nitrogen-richer component and oxygen-enriched component;

(C) providing oxygen-enriched component into an auxiliary column operating at a pressure less than that of the primary column;

(D) separating oxygen-enriched component into nitrogen-enriched vapor and oxygen-richer liquid;

(E) condensing nitrogen-enriched vapor by indirect heat exchange with oxygen-richer liquid to produce nitrogen-enriched liquid;

(F) increasing the pressure of the nitrogen-enriched liquid to substantially the operating pressure of the primary column;

(G) providing pressurized nitrogen-enriched liquid into the primary column for further production of nitrogen-richer component; and (H) recovering nitrogen-richer component from the primary column as product elevated pressure nitrogen.

2. The method of claim 1 wherein a portion of the nitrogen-richer component is condensed and employed in the primary column as reflux.

3. The method of claim 2 wherein the nitrogen-richer component is condensed by indirect heat exchange with oxygen-enriched component and resulting oxygen-enriched component is passed into the auxiliary column.

4. The method of claim 3 wherein the oxygen-enriched component is partially vaporized by the indirect heat exchange with condensing nitrogen-richer component and both the resulting oxygen-enriched vapor and oxygen-enriched liquid are passed into the auxiliary column.

5. The method of claim 1 wherein the pressure of the nitrogen-enriched liquid is increased by liquid pumping.

6. The method of claim 1 further comprising liquefying a portion of the compressed feed air prior to the introduction of such portion into the primary column.

7. The method of claim 6 wherein the said feed air portion is liquified by indirect heat exchange with bottoms of the auxiliary column thereby providing vapor upflow for the auxiliary column.

8. The method of claim 1 further comprising turboexpanding a portion of the compressed feed air to generate refrigeration and introducing the turboexpanded feed air portion into the auxiliary column to provide refrigeration into the system.

9. The method of claim 1 further comprising turboexpanding a portion of the oxygen-enriched component and passing said turboexpanded portion in indirect heat exchange with compressed feed air to provide refrigeration into the system.

10. The method of claim 1 wherein a portion of the nitrogen-richer component is turboexpanded to generate refrigeration and the turboexpanded nitrogen-richer portion is passed in indirect heat exchange with compressed feed air to provide refrigeration into the system.

11. Apparatus for producing elevated pressure nitrogen with improved recovery comprising:

(A) a primary column having a top condenser and means for providing feed into the primary column;

(B) means for providing fluid from the lower portion of the primary column into the top condenser;

(C) an auxiliary column having a top condenser;

(D) means for providing fluid from the primary column top condenser into the auxiliary column;

(E) means for providing liquid from the auxiliary column top condenser into the primary column including means for increasing the pressure of said liquid; and (F) means for recovering product from the primary column.

12. The apparatus of claim 11 wherein the pressure increasing means comprises a liquid pump.

13. The apparatus of claim 11 further comprising a turboexpander, means to provide feed into the turboexpander and means to provide feed from the turboexpander into the auxiliary column.

14. The apparatus of claim 11 further comprising a turboexpander, means to provide fluid from the primary column top condenser into the turboexpander and means to provide fluid from the turboexpander in indirect heat exchange with feed.

15. The apparatus of claim 11 further comprising means to liquefy a portion of the feed prior to that portion being provided into the primary column.

16. The apparatus of claim 15 wherein the means for liquefying said portion of the feed comprises a reboiler in the lower portion of the auxiliary column.

* * * * *